US009699847B2

(12) United States Patent
Hiramatsu et al.

(10) Patent No.: US 9,699,847 B2
(45) Date of Patent: Jul. 4, 2017

(54) LIGHT SOURCE UNIT AND LIGHTING FIXTURE

(71) Applicant: Panasonic Intellectual Property Management Co., Ltd., Osaka (JP)

(72) Inventors: Akinori Hiramatsu, Nara (JP); Shigeru Ido, Osaka (JP); Daisuke Ueda, Osaka (JP); Hiroshi Kido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/011,739

(22) Filed: Feb. 1, 2016

(65) Prior Publication Data

US 2016/0242249 A1 Aug. 18, 2016

(30) Foreign Application Priority Data

Feb. 12, 2015 (JP) ..... 2015-025735

(51) Int. Cl.
*H05B 33/08* (2006.01)

(52) U.S. Cl.
CPC ..... *H05B 33/0824* (2013.01); *H05B 33/0803* (2013.01); *H05B 33/0854* (2013.01)

(58) Field of Classification Search
CPC ..... H05B 37/02; H05B 39/04; H05B 41/36; H05B 37/00; H05B 39/00; H05B 41/00; Y02B 20/387; Y02B 20/348
(Continued)

(56) References Cited

U.S. PATENT DOCUMENTS 7,081,722 B1 7/2006 Huynh et al.
7,671,539 B1 * 3/2010 Mentzer ..... H05B 33/0803 315/149
(Continued)

FOREIGN PATENT DOCUMENTS

JP 2007-123562 A 5/2007
JP 2010-272838 A 12/2010
(Continued)

OTHER PUBLICATIONS

Title: LED Lighting device provided with automatic flicker circuit, Author: Kubo Atsushi, Publisher: 2012-133971.*
(Continued)

*Primary Examiner* — Douglas W Owens
*Assistant Examiner* — Wei Chan
(74) *Attorney, Agent, or Firm* — Renner, Otto, Boisselle & Sklar, LLP

(57) ABSTRACT

The light source unit includes a light source circuit including N (N≥3) pairs of a light source group including one or more solid light emitting elements and a constant current circuit connected in series with the light source group to keep, constant, current flowing through the light source group, a full-wave rectification circuit for performing full-wave rectification on AC voltage, and a control circuit. The first pair is connected to the full-wave rectification circuit. The k-th (2≤k≤N) pair is connected in parallel with the constant current circuit of the (k−1)-th pair so that the light source groups of the k-th and (k−1)-th pairs are in series. The control circuit terminates operations of the constant current circuits of the N pairs or limits currents flowing through the light source groups of the N pairs in response to detection of light or a signal.

5 Claims, 7 Drawing Sheets

(58) Field of Classification Search
USPC ..... 315/113, 117, 200 R, 201, 308, 88, 90, 315/185 R, 291; 362/253, 249.01, 231
See application file for complete search history.

(56) References Cited

U.S. PATENT DOCUMENTS

| | | | | |
|---|---|---|---|---|
| 2010/0295458 | A1 | 11/2010 | Cheng et al. | |
| 2011/0051438 | A1* | 3/2011 | Lee | F21S 8/086 362/428 |
| 2012/0306382 | A1* | 12/2012 | Maxik | F21S 2/00 315/152 |
| 2014/0159599 | A1* | 6/2014 | Tetik | H05B 33/0845 315/193 |

FOREIGN PATENT DOCUMENTS

| | | | |
|---|---|---|---|
| JP | 2011-238898 | A | 11/2011 |
| JP | 2012-133971 | A | 7/2012 |
| JP | 2013-225393 | A | 10/2013 |

OTHER PUBLICATIONS

Title: LED Lighting device provided with automatic flicker circuit, Author: Kubo Atsushi, Publisher: 2012-133971 (Translation).*

* cited by examiner

LIGHT SOURCE UNIT AND LIGHTING FIXTURE

CROSS-REFERENCE TO RELATED APPLICATION

The application is based upon and claims the benefit of priority of Japanese Patent Application No. 2015-025735, filed on Feb. 12, 2015, the entire contents of which are incorporated herein by reference.

TECHNICAL FIELD

The present disclosure relates to light source units and lighting fixtures.

BACKGROUND ART

In the past, there have been proposed light-emitting diode (LED) devices configured to operate a group of LEDs with pulsating voltage obtained by rectification on commercial power (see Document 1 [U.S. Pat. No. 7,081,722 B1]).

Improvement of functionality of light source units such as the LED devices disclosed in document 1 is highly demanded.

SUMMARY

The present disclosure is directed to a light source unit and a lighting fixture which have improved functionality.

The light source unit of one aspect according to the present disclosure includes: a light source circuit including N pairs of a light source group including one or more solid light emitting elements and a constant current circuit connected in series with the light source group to keep, constant, current flowing through the light source group, where N is an integer equal to or greater than 3; a full-wave rectification circuit which includes a first output end and a second output end and is configured to perform full-wave rectification on AC voltage to cause DC voltage between the first output end and the second output end; and a control circuit including a detector configured to detect light or signal from an external source. A first pair of the N pairs is connected between the first output end and the second output end of the full-wave rectification circuit. A k-th pair of the N pairs is connected in parallel with the constant current circuit of a (k−1)-th pair of the N pairs so that the light source group of the k-th pair and the light source group of the (k−1)-th pair are in series, where k is an integer equal to or greater than 2 and equal to or smaller than N. The control circuit is configured to, when the detector detects the light or signal, terminate operations of constant current circuits of the N pairs or limit current flowing through light source groups of the N pairs.

The lighting fixture of one aspect of the present disclosure includes the above light source unit and an attaching member for holding the light source unit.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Embodiments according to the present disclosure generally relate to light source units and lighting fixtures including the same, and particularly relate to a light source unit including one or more solid light emitting elements and a lighting fixture including the same.

(Embodiment 1)

Figure 1:
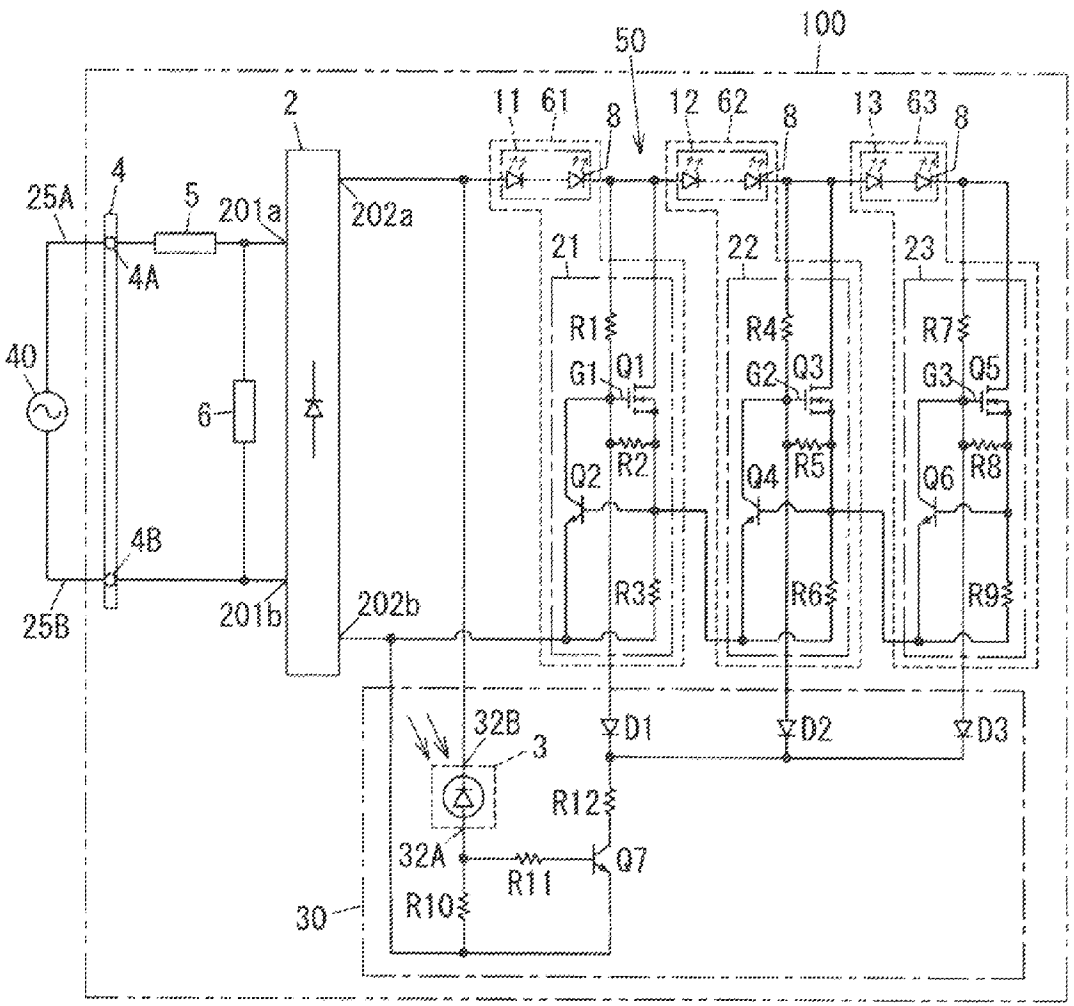
FIG. 1 is a circuit diagram illustrating a light source unit of Embodiment 1 according to the present disclosure.
Figure 2:
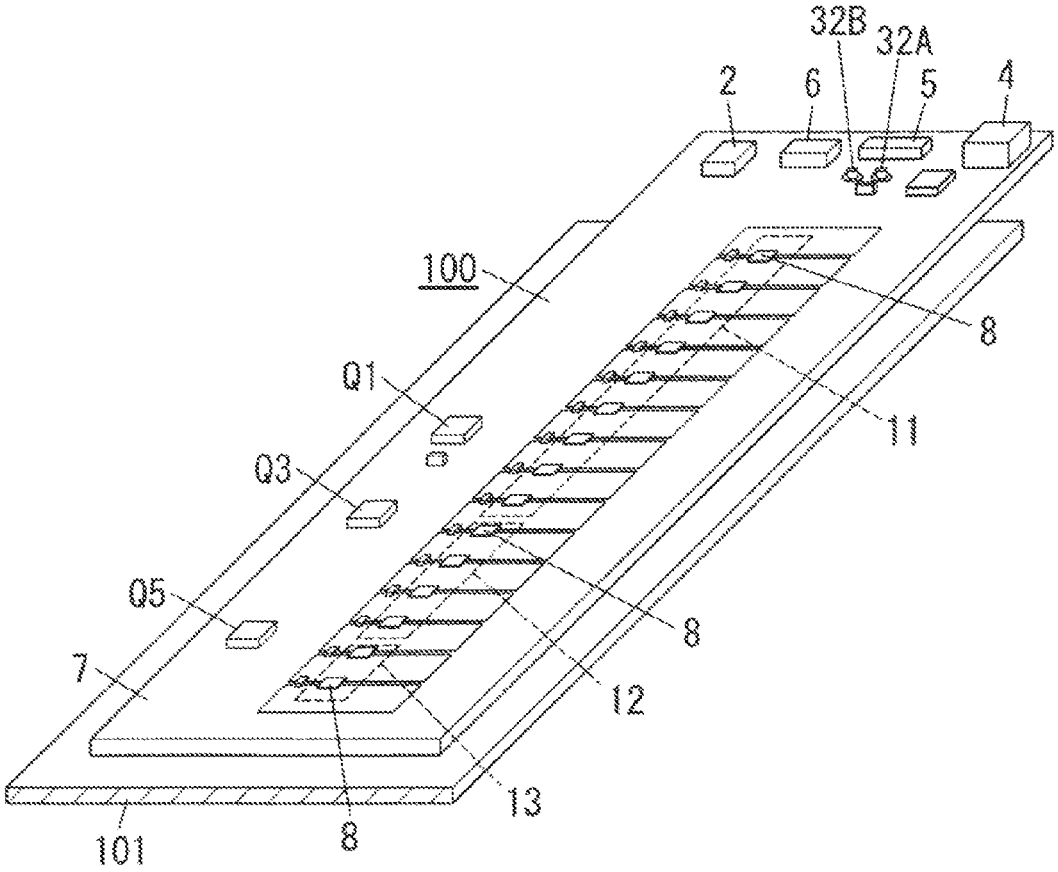
FIG. 2 is a schematic perspective view illustrating a situation where the light source unit of Embodiment 1 is attached to an attaching member.
Figure 3:
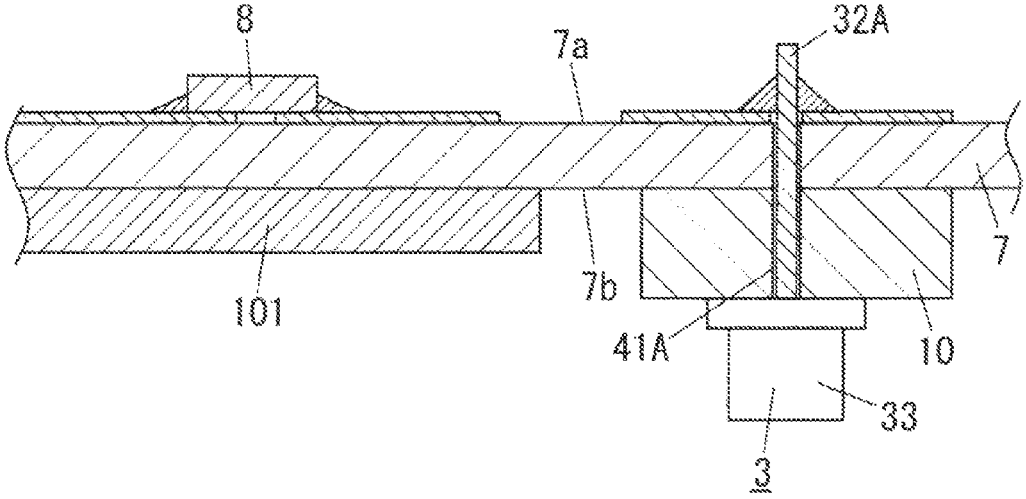
FIG. 3 relates to the situation where the light source unit of Embodiment 1 is attached to the attaching member, and is an explanatory view in cross-section illustrating a location of a detector.
Figure 4:
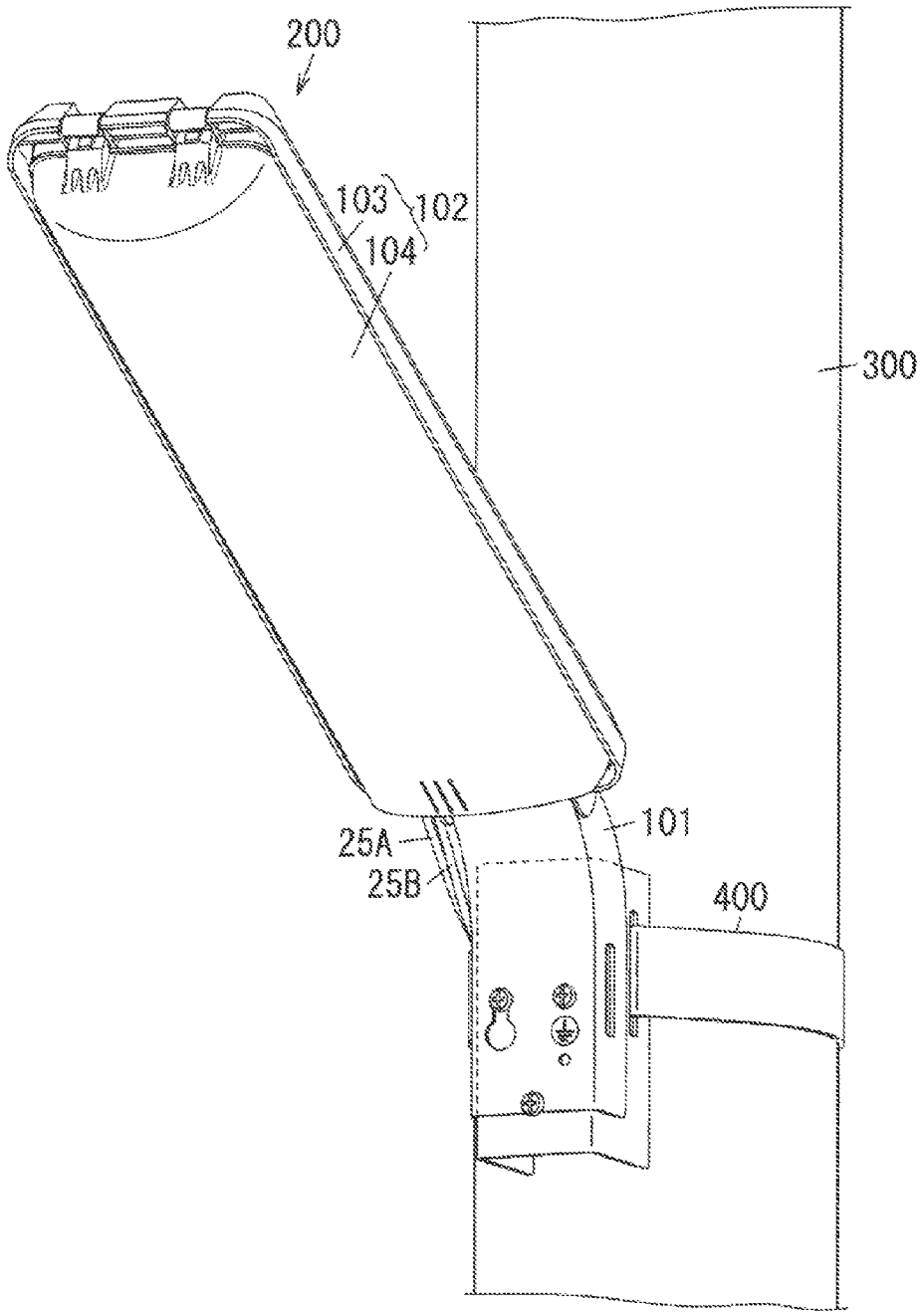
FIG. 4 is a perspective view illustrating a situation where a lighting fixture including the light source unit of Embodiment 1 is installed.

The following explanations referring to FIG. 1 to FIG. 3 are made to a light source unit 100 of Embodiment 1. Note that, hereinafter, for convenience in explanations, a lighting fixture 200 including the light source unit 100 is described initially with reference to FIG. 4, and then the light source unit 100 is described in detail.

The lighting fixture 200 is a street light for example. The lighting fixture 200 is attached to a supporting post 300 situated on the ground surface or the like, for example. The supporting post 300 may be a utility pole, a steel pipe pole, or the like.

The lighting fixture 200 includes the light source unit 100, an attaching member 101, and a casing 102. Note that, the light source unit 100 is accommodated in the casing 102, and therefore the light source unit 100 is not shown in FIG. 4.

The attaching member 101 supports the light source unit 100 housed within the casing 102. Further, the attaching member 101 is attached to the supporting post 300 with a fixing member 400. The attaching member 101 is made of a metal plate such as a steel plate, for example. The fixing member 400 may be, for example, a metal band which straps the attaching member 101 to the supporting post 300.

The attaching member 101 is designed so that the light source unit 100 is inclined relative to the ground surface at a predetermined angle (e.g., 60 degrees) in a situation where the attaching member 101 is attached to the supporting post 300 with the fixing member 400.

The casing 102 is configured to accommodate the light source unit 100. The casing 102 includes a body 103 and a cover 104.

The body 103 is fixed to the attaching member 101. The body 103 is in a box shape (e.g., a rectangular box shape) having a surface with an opening. The body 103 is made of synthetic resin, for example.

The body 103 includes a through hole (first through hole) allowing passage of a pair of power cables 25A and 25B. The pair of power cables 25A and 25B is used for electrically interconnecting an external power supply 40 (see FIG. 1) and the light source unit 100. The external power supply 40 is an AC power supply (e.g., a commercial power supply) for outputting sinusoidal AC voltage.

The body 103 includes a through hole (second through hole) which allows partial insertion of the attaching member 101.

The cover 104 is attached to the body 103 so as to cover the opening of the body 103. Thus, the cover 104 covers the light source unit 100. The cover 104 is made of transparent or translucent material.

As shown in FIG. 1, the light source unit 100 includes three light source groups 11 to 13, a full-wave rectification circuit 2, three constant current circuits 21 to 23, and a control circuit 30. Further, the light source unit 100 includes a connector 4, a fuse 5, a varistor 6, and a substrate 7 (see FIG. 2). The connector 4 is designed to make electric connection with the pair of power cables 25A and 25B. The connector 4 includes a pair of terminals 4A and 4B.

The light source group 11 includes multiple (nine in the present embodiment) solid light emitting elements 8, for example. Each of the multiple solid light emitting elements 8 is an LED, for example. Electric connection between the multiple solid light emitting elements 8 is series connection, for example. To turn on the light source group 11, it is necessary to supply the light source group 11 with voltage equal to or greater than a voltage (hereinafter referred to as the lighting voltage) which is determined by the electric connection between the multiple solid light emitting elements 8 and threshold voltages of the multiple solid light emitting elements 8. For example, when the electric connection between the nine solid light emitting elements 8 is series connection, and individual threshold voltages of the nine solid light emitting elements 8 are 3.5 V, the lighting voltage is 31.5 V(=9×3.5 V).

Note that, the electric connection between the multiple solid light emitting elements 8 is not limited to the series connection, but may be parallel connection or a combination of series connection and parallel connection. Further, each of the multiple solid light emitting elements 8 is not limited to an LED, but may be an organic electroluminescence element, a semiconductor laser element, or the like. Additionally, the light source group 11 includes multiple solid light emitting elements but may include only one solid light emitting element.

Each of the two light source groups 12 and 13 has the same structure as the light source group 11 except the number of solid light emitting elements 8. For this reason, detailed descriptions as for the two light source groups 12 and 13 are omitted. For example, as shown in FIG. 2, the light source group 12 includes four solid light emitting elements 8, and the light source group 13 includes two solid light emitting elements 8.

In each of the light source groups 11, 12, and 13, an anode of a solid light emitting element 8 whose cathode is not connected to another solid light emitting element 8 defines an input terminal, and a cathode of a solid light emitting element 8 whose anode is not connected to another solid light emitting element 8 defines an output terminal.

The full-wave rectification circuit 2 is configured to perform full-wave rectification on AC voltage. In more detail, the full-wave rectification circuit 2 includes a pair of input ends (first and second input ends) 201*a* and 201*b*, and a pair of output ends (first and second output ends) 202*a* and 202*b*. The full-wave rectification circuit 2 is configured to perform full-wave rectification on AC voltage applied between the pair of input ends 201*a* and 201*b* to thereby cause DC voltage between the pair of output ends 202*a* and 202*b*. Further, the full-wave rectification circuit 2 is configured to cause the DC voltage between the first output end 202*a* and the second output end 202*b* so that an electric potential at the first output end 202*a* is higher than an electric potential at the second output end 202*b*. The full-wave rectification circuit 2 is a diode bridge, for example.

The varistor 6 is electrically connected between the pair of input ends 201*a* and 201*b* of the full-wave rectification circuit 2. An input terminal (the first input end) 201*a* for receiving a higher electric potential of the pair of input ends 201*a* and 201*b* of the full-wave rectification circuit 2 is electrically connected to the terminal 4A of the connector 4 through the fuse 5. An input terminal (the second input end) 201*b* for receiving a lower electric potential of the pair of input ends 201*a* and 201*b* of the full-wave rectification circuit 2 is electrically connected to the terminal 4B of the connector 4.

A series circuit (a first light source part) 61 of the light source group 11 and the constant current circuit 21 is electrically connected between the pair of output ends 202*a* and 202*b* of the full-wave rectification circuit 2. In other words, the first light source part 61 is connected between the first output end 202*a* and the second output end 202*b* of the full-wave rectification circuit 2.

The constant current circuit 21 is configured to keep current flowing through the light source group 11 constant. The constant current circuit 21 includes a switching element Q1 connected to the light source group 11, and is configured to keep current flowing through the switching element Q1 constant. The constant current circuit 21 includes, for example, two switching elements (first and second switching elements) Q1 and Q2, and three resistors (first to third resistors) R1 to R3.

The switching element Q1 includes a first terminal, a second terminal, and a control terminal G1. The switching element Q1 is, for example, an enhancement mode n-channel MOSFET. In this case, the first terminal, the second terminal, and the control terminal G1 of the switching element Q1 correspond to a drain terminal, a source terminal, and a gate terminal, respectively.

The switching element Q2 includes a first terminal, a second terminal, and a control terminal. The switching element Q2 is, for example, an npn-type bipolar transistor. In this case, the first terminal, the second terminal, and the control terminal of the switching element Q2 correspond to a collector terminal, an emitter terminal, and a base terminal, respectively.

The resistor R1 has a first end electrically connected to a cathode side connection terminal (output terminal) of the light source group 11. The resistor R1 has a second end electrically connected to the gate terminal of the switching element Q1. Additionally, the second end of the resistor R1 is electrically connected to the collector terminal of the switching element Q2. Further, the second end of the resistor R1 is electrically connected to a first end of the resistor R2. The first end of the resistor R2 is electrically connected to the control circuit 30.

The drain terminal of the switching element Q1 is electrically connected to the first end of the resistor Rl. The source terminal of the switching element Q1 is electrically connected to a second end of the resistor R2. The second end of the resistor R2 is electrically connected to the base terminal of the switching element Q2. Further, the second end of the resistor R2 is electrically connected to a first end of the resistor R3. The resistor R3 has a second end electrically connected to the emitter terminal of the switching element Q2.

A series circuit (a second light source part) 62 of the light source group 12 and the constant current circuit 22 is electrically connected to the constant current circuit 21. As shown in FIG. 1, the second light source part 62 is connected in parallel with the constant current circuit 21 of the first light source part 61 so that the light source groups 11 and 12 are in series. In more detail, the second light source part 62 is connected in parallel with the switching element Q1 of the constant current circuit 21 of the first light source part 61.

The constant current circuit 22 is configured to keep current flowing through the light source group 12 constant. As shown in FIG. 1, the constant current circuit 22 includes two switching elements (first and second switching elements) Q3 and Q4, and three resistors (first to third resistors) R4 to R6. The constant current circuit 22 is the same in circuit configuration as the constant current circuit 21, and hence detailed descriptions as for the constant current circuit 22 are omitted.

A series circuit (a third light source part) 63 of the light source group 13 and the constant current circuit 23 is electrically connected to the constant current circuit 22. As shown in FIG. 1, the third light source part 63 is connected in parallel with the constant current circuit 22 of the second light source part 62 so that the light source groups 12 and 13 are in series. In more detail, the third light source part 63 is connected in parallel with the switching element Q3 of the constant current circuit 22 of the second light source part 62.

The constant current circuit 23 is configured to keep current flowing through the light source group 13 constant. As shown in FIG. 1, the constant current circuit 23 includes two switching elements (first and second switching elements) Q5 and Q6, and three resistors (first to third resistors) R7 to R9. The constant current circuit 23 is the same in circuit configurations as the constant current circuit 21, and hence detailed descriptions as for the constant current circuit 23 are omitted.

Note that, the first switching elements Q1, Q3, and Q5 are not limited to enhancement mode n-channel MOSFETs but may be npn-type bipolar transistors. Further, the second switching elements Q2, Q4, and Q6 are not limited to npn-type bipolar transistors.

Further, the constant current circuits 21 to 23 are not limited to having the above circuit configurations, but may be a circuit with configurations equivalent to the above circuit configurations.

As apparent from the above, the light source unit 100 includes a light source circuit 50 constituted by the three light source parts 61, 62, and 63.

The control circuit 30 is configured to control the three constant current circuits 21 to 23. For example, the control circuit 30 includes a detector 3, a switching element Q7, three resistors R10 to R12, and three diodes D1 to D3.

The detector 3 is configured to detect light from an external source (e.g., surroundings of the lighting fixture 200). In other words, the detector 3 is configured to measure luminance of the surroundings of the lighting fixture 200. The detector 3 is, for example, a light sensor. In the present embodiment, the detector 3 is a light sensor (manufacturer's part number: AMS302) available from Panasonic Corporation, for example. The detector 3 includes an anode terminal 32A (see FIG. 2), a cathode terminal 32B (see FIG. 2), and a main body 33 (see FIG. 3). The main body 33 contains a functional element including a photodiode for detecting light from the external source, for example, and this functional element is electrically connected to each of the anode terminal 32A and the cathode terminal 32B. Note that, in the following, for convenience in explanations, light from the external source is referred to as "external light".

The switching element Q7 includes a first terminal, a second terminal, and a control terminal. The switching element Q7 is, for example, an npn-type bipolar transistor. In this case, the first terminal, the second terminal, and the control terminal of the switching element Q7 correspond to a collector terminal, an emitter terminal, and a base terminal, respectively.

The cathode terminal 32B of the detector 3 is electrically connected to the output end (the first output end) 202*a* for receiving the higher electric potential of the pair of output ends 202*a* and 202*b* of the full-wave rectification circuit 2. The anode terminal 32A of the detector 3 is electrically connected to a first end of the resistor R10. Further, the anode terminal 32A of the detector 3 is electrically connected to a first end of the resistor R11. The resistor R10 has a second end electrically connected to the output end (the second output end) 202*b* for receiving the lower electric potential of the pair of output ends 202*a* and 202*b* of the full-wave rectification circuit 2. The resistor R11 has a second end electrically connected to the base terminal of the switching element Q7.

The collector terminal of the switching element Q7 is electrically connected to a first end of the resistor R12. The resistor R12 has a second end electrically connected to cathodes of the respective three diodes D1 to D3. The emitter terminal of the switching element Q7 is electrically connected to the second end of the resistor R10. The switching element Q7 is a switching part electrically connected between the second output end 202*b* and control terminals G1, G2, and G3 of the switching elements Q1, Q3, and Q5 of the constant current circuits 21 to 23 of the three light source parts 61 to 63.

The diode D1 has an anode electrically connected to the constant current circuit 21 (in more detail, the first end of the resistor R2 in the constant current circuit 21). The diode D2 has an anode electrically connected to the constant current circuit 22 (in more detail, the first end of the resistor R5 in the constant current circuit 22). The diode D3 has an anode electrically connected to the constant current circuit 23 (in more detail, the first end of the resistor R8 in the constant current circuit 23).

The substrate 7 (see FIG. 2) is designed to allow electrical connection between multiple electronic parts constituting the three light source groups 11 to 13, the full-wave rectification circuit 2, and the three constant current circuits 21 to 23. Further, the substrate 7 is designed to allow electrical connection between multiple electronic pats constituting the control circuit 30, the connector 4, the fuse 5, and the varistor 6. The substrate 7 is, for example, a printed wiring board. Further, the substrate 7 has, for example, a rectangular shape.

The light source unit 100 is attached to the attaching member 101 so that an end (e.g., right upper end in FIG. 2) of the substrate 7 in a lengthwise direction extends from the attaching member 101.

The multiple (in the present embodiment, fifteen) solid light emitting elements 8, the full-wave rectification circuit 2, the three switching elements Q1, Q3, and Q5, the connector 4, the fuse 5, the varistor 6, and others are arranged on a front surface (in FIG. 2, an upper surface) 7*a* (see FIG. 3) of the substrate 7.

The main body 33 of the detector 3 is situated on a spacer 10 (see FIG. 3) on a rear surface (in FIG. 2, a lower surface) 7*b* of the substrate 7. In more detail, the main body 33 of the detector 3 is situated on the spacer 10 on the rear surface 7*b* so as to close to the aforementioned end of the substrate 7.

The spacer 10 is provided for keeping a distance between the main body 33 of the detector 3 and the casing 102. Further, the spacer 10 includes a pair of holes 41A and 41B (not shown) which allow the anode terminal 32A and the cathode terminal 32B of the detector 3 to pass therethrough respectively. Note that, the main body 33 of the detector 3 is situated on the spacer 10 on the rear surface 7*b* of the substrate 7, but may be situated on the rear surface 7*b* of the substrate 7 without the spacer 10. In FIG. 3, only the anode terminal 32A of the anode terminal 32A and the cathode terminal 32B is visible. Further, in FIG. 3, only the hole 41A of the holes 41A and 41B is visible.

The light source unit 100 is configured to turn on the three light source groups 11 to 13 with voltage (pulsating voltage) resulting from full-wave rectification performed by the full-wave rectification circuit 2.

The pulsating voltage is voltage having an instantaneous value changing periodically. The light source circuit 50 has a series circuit of the light source groups 11 to 13. Accordingly, while the instantaneous value of the pulsating voltage is less than the lighting voltage of the light source group 11, no current flows through the light source group 11, and therefore the light source circuit 50 does not emit light. In this case, the light source unit 100 is in an off-state.

Thereafter, when the instantaneous value of the pulsating voltage increases and comes to a value equal to or greater than the lighting voltage of the light source group 11, current starts to flow through a series circuit of the light source group 11 and the resistors R1, R2, and R3, and then the switching elements Q1 and Q2 operate within in their active regions. Hence, the current flowing through the light source group 11 is kept constant. In this case, the light source unit 100 is in a first lighting state in which only the light source group 11 of the three light source groups 11 to 13 is on.

Subsequently, when the instantaneous value of the pulsating voltage further increases and comes to a value equal to or greater than the total of the lighting voltages of the light source groups 11 and 12, current starts to flow through a series circuit of the light source groups 11 and 12 and the resistors R4, R5, and R6, and then current flowing through a series circuit of the resistors R1, R2, and R3 decreases. As a result, the switching elements Q1 and Q2 are turned off but alternatively the switching elements Q3 and Q4 operate within their active regions, and therefore the current flowing through the light source groups 11 and 12 is kept constant. In this case, the light source unit 100 is in a second lighting state in which only the two light source groups 11 and 12 of the three light source groups 11 to 13 are on.

After that, when the instantaneous value of the pulsating voltage further increases and comes to a value equal to or greater than the total of the lighting voltages of the light source groups 11, 12, and 13, current starts to flow through a series circuit of the light source groups 11, 12, and 13 and the resistors R7, R8, and R9, and then current flowing through a series circuit of the resistors R4, R5, and R6 decreases. As a result, the switching elements Q3 and Q4 are turned off but alternatively the switching elements Q5 and Q6 operate within their active regions, and therefore the current flowing through the light source groups 11, 12, and 13 is kept constant. In this case, the light source unit 100 is in a third lighting state in which all the three light source groups 11 to 13 are on.

Thereafter, when the instantaneous value of the pulsating voltage decreases and comes to a value less than the total of the lighting voltages of the light source groups 11, 12, and 13, current starts to flow through the series circuit of the light source groups 11 and 12 and the resistors R4, R5, and R6. Thus, the switching elements Q5 and Q6 are turned off but alternatively the switching elements Q3 and Q4 operate within their active regions, and therefore the current flowing through the light source groups 11 and 12 is kept constant. In this case, the light source unit 100 is in the second lighting state.

Subsequently, when the instantaneous value of the pulsating voltage further decreases and comes to a value less than the total of the lighting voltages of the light source groups 11 and 12, current starts to flow through the series circuit of the light source group 11 and the resistors R1, R2, and R3. Thus, the switching elements Q3 and Q4 are turned off but alternatively the switching elements Q1 and Q2 operate within their active regions, and therefore the current flowing through the light source group 11 is kept constant. In this case, the light source unit 100 is in the first lighting state.

After that, when the instantaneous value of the pulsating voltage further decreases and comes to a value less than the lighting voltage of the light source group 11, no current flows through the light source group 11, and therefore the light source circuit 50 does not emit light. In this case, the light source unit 100 is in the off-state.

During one period of the pulsating voltage, the state of the light source unit 100 is changed to the off-state, the first lighting state, the second lighting state, the third lighting state, the second lighting state, the first lighting state, and the off-state, in this order.

As apparent from the above, the light source unit 100 turns on the three light source groups 11 to 13 in order by switching the three switching elements Q1, Q3, and Q5 from the off-state to the on-state (in more detail, a state in which a switching element operates within its active region) in turn based on the instantaneous value of the voltage resulting from the full-wave rectification done by the full-wave rectification circuit 2. Note that, turning on the three light source groups 11 to 13 in this order means turning on the light source group 11 and then turning on the light source group 12 while keeping the lighting state of the light source group 11 and finally turning on the light source group 13 while keeping the lighting states of the two light source groups 11 and 12.

Further, the light source unit 100 turns off the three light source groups 11 to 13 in order by switching the three switching elements Q1, Q3, and Q5 from the on-state (in more detail, a state in which a switching element operates within its active region) to the off-state in turn based on the instantaneous value of the voltage resulting from the full-wave rectification done by the full-wave rectification circuit 2. Note that, turning off the three light source groups 11 to 13 in order means turning off the light source group 13 of the three light source groups 11 to 13 being in the lighting state, and then turning off the light source group 12, and finally turning off the light source group 11.

The control circuit 30 is configured to, when the detector 3 detects the external light, control the three constant current circuits 21 to 23 so as to terminate operations of the respective three constant current circuits 21 to 23. In other words, the control circuit 30 is configured to, when the surroundings of the lighting fixture 200 become bright, control the three constant current circuits 21 to 23 so as to terminate operations of the respective three constant current circuits 21 to 23.

In the light source unit 100, when the surroundings of the lighting fixture 200 become dark, an impedance component of the detector 3 (light sensor) increases, and thus no current flows into the base terminal of the switching element Q7, and therefore the switching element Q7 is kept off. In this case, an electric potential at the control terminal G1 of the switching element Q1 is determined by a bias circuit constituted by the switching element Q2 and the resistors R2 and R3. This is true for the switching elements Q3 and Q5. Therefore, the light source unit 100 allows switching operations of the three switching elements Q1, Q3, and Q5. In other words, the light source unit 100 allows the three constant current circuits 21 to 23 to operate. Thus, when the surroundings of the lighting fixture 200 become dark, the light source unit 100 can turn on the three light source groups 11 to 13 in order. Note that, the state in which the surroundings of the lighting fixture 200 become dark means the state in which an output level of the external light detected by the detector 3 is less than a criterion level.

In contrast, in the light source unit 100, when the surroundings of the lighting fixture 200 become bright, an impedance component of the detector 3 (light sensor) decreases, and thus current starts to flow into the base terminal of the switching element Q7, and finally the switching element Q7 is turned on. In this case, electric potentials at the control terminals G1, G2, and G3 of the three switching elements Q1, Q3, and Q5 are determined by the electric potential at the second output end 202*b* of the full-wave rectification circuit 2, and as a result are equal to about zero. Therefore, in the light source unit 100, the three switching elements Q1, Q3, and Q5 are kept off, and thus it is possible to terminate operations of the individual three constant current circuits 21 to 23. Thus, when the surroundings of the lighting fixture 200 become bright, the light source unit 100 can turn off the three light source groups 11 to 13. Note that, the state in which the surroundings of the lighting fixture 200 become bright means the state in which an output level of the external light detected by the detector 3 is equal to or greater than a criterion level.

Note that, in the light source unit 100, the impedance component of the light sensor used as the detector 3 changes depending on an amount of light of the surroundings of the lighting fixture 200, and therefore it is possible to change the base-emitter voltage of the switching element Q7. In other words, the control circuit 30 is configured to allow the switching element Q7 to act as a resistance component. Therefore, in the light source unit 100, the switching element Q7 can be used to operate within a region (active region) so that collector current changes in proportion to change in base-emitter voltage. For example, as for the constant current circuit 21, increase in the collector current of the switching element Q7 causes decrease in current flowing through a series circuit of the resistors R2 and R3, and thus gate-source voltage of the switching element Q1 decreases. Decrease in the collector current of the switching element Q7 causes increase in the current flowing through the series circuit of the resistors R2 and R3, and thus gate-source voltage of the switching element Q1 increases. Therefore, the light source unit 100 can increase or decrease the gate-source voltage of each of the switching elements Q1, Q3, and Q5, and thereby can increase or decrease currents individually flowing through the switching elements Q1, Q3, and Q5. Consequently, the light source unit 100 can adjust values of the currents flowing through the individual three light source groups 11 to 13 depending on an amount of light of surroundings of the lighting fixture 200.

The control circuit 30 is configured to, when the detector 3 detects the external light, control the three constant current circuits 21 to 23 so as to terminate operations of the individual three constant current circuits 21 to 23, but is not limited to having this configuration. The control circuit 30 may be configured to, when the detector 3 detects the external light, control the three constant current circuits 21 to 23 so as to decrease values of currents flowing through the individual three light source groups 11 to 13. To realize this configuration, the circuit is designed so as to allow the switching element Q7 to operate within the active region, as described above. Accordingly, when the surroundings of the lighting fixture 200 become bright, the light source unit 100 can reduce current flowing through the individual three light source groups 11 to 13. In other words, when the surroundings of the lighting fixture 200 become bright, the light source unit 100 can reduce output of light emitted from the individual three light source groups 11 to 13.

The detector 3 is configured to detect external light, but is not limited to having such configurations. The detector 3 may be configured to detect signals (fault signals) from external devices (e.g., fault detecting devices). The fault detecting devices may include overvoltage detecting devices and overcurrent detecting devices. In this case, when the detector 3 detects a fault signal, the light source unit 100 turns off the three light source groups 11 to 13.

Further, the detector 3 may be configured to detect signals (remote control signals) from remote controllers which are transmitted through infrared rays or radio waves. In this case, when the detector 3 detects a remote control signal, the light source unit 100 turns on or off the three light source groups 11 to 13 according to information included in this remote control signal (e.g., an order indicative of turning on the three light source groups 11 to 13), for example.

The switching element Q7 is not limited to an npn-type bipolar transistor, but may be an enhancement mode n-channel MOSFET, for example.

As described above, the light source unit 100 of the present embodiment includes: at least three light source groups 11 to 13; a full-wave rectification circuit 2 configured to perform full-wave rectification on AC voltage; at least three constant current circuits 21 to 23; and a control circuit 30 for controlling the at least three constant current circuits 21 to 23. Each of the at least three light source groups 11 to 13 includes a solid light emitting element 8. Each of the at least three constant current circuits 21 to 23 is configured to keep, constant, current flowing through a corresponding one of the at least three light source groups 11 to 13. Connected between a pair of output ends 202*a* and 202*b* of the full-wave rectification circuit 2 is a series circuit of a first light source group (light source group 11) and a first constant current circuit (constant current circuit 21), the first light source group being a light source group which is one of the at least three light source groups 11 to 13, and the first constant current circuit being a constant current circuit which is one of the at least three constant current circuits 21 to 23. Connected to the first constant current circuit is a series circuit of a second light source group (light source group 12) and a second constant current circuit (constant current circuit 22), the second light source group being a light source group which is one of the at least three light source groups 11 to 13 but is different from the first light source group, and the second constant current circuit being a constant current circuit which is one of the at least three constant current circuits 21 to 23 but is different from the first constant current circuit. Connected to the second constant current circuit is a series circuit of a third light source group (light source group 13) and a third constant current circuit (constant current circuit 23), the third light source group being a light source group which is one of the at least three light source groups 11 to 13 but is different from the first and second light source groups, and the third constant current circuit being a constant current circuit which is one of the at least three constant current circuits 21 to 23 but is different from the first and second constant current circuits. The control circuit 30 includes a detector 3 configured to detect light or a signal from an external source. The control circuit 30 is configured to, when the detector 3 detects the light or signal, control the at least three constant current circuits 21 to 23 so as to terminate operations of the at least three constant current circuits 21 to 23 or decrease values of currents flowing through the at least three light source groups 11 to 13. Accordingly, for example, in a case where the detector 3 is a light sensor, the light source unit 100 can turn off the at least three light source groups 11 to 13 when the surroundings of the lighting fixture 200 become bright. Alternatively, for example, in a case where the detector 3 is a light sensor, the light source unit 100 can reduce current flowing through the at least three light source groups 11 to 13 when the surroundings of the lighting fixture 200 become bright. Consequently, it is possible to improve the functionality of the light source unit 100.

Additionally, in the light source unit 100, the control circuit 30 includes the switching element Q7, and is configured to allow the switching element Q7 to act as a resistance component. In this case, in the light source unit 100, the switching element Q7 can be used to operate within a region (active region) so that current (collector current) flowing through the first terminal changes in proportion to change in voltage (base-emitter voltage) between the control terminal and the second terminal. Therefore, in the light source unit 100, it is possible to increase or decrease voltage (gate-source voltage) between the control terminal and the second terminal with regard to each of the switching elements Q1, Q3, and Q5. In short, in the light source unit 100, currents individually flowing through the switching elements Q1, Q3, and Q5 can be increased or decreased. For this reason, in the light source unit 100, it is possible to change values of the currents individually flowing through the at least three light source groups 11 to 13 depending on an amount of light of the surroundings of the lighting fixture 200. This can lead to improvement of the functionality of the light source unit 100.

Further, in the light source unit 100, the detector 3 is situated on the substrate 7, and therefore in contrast to an example where the detector 3 is not situated on the substrate 7, it is possible to facilitate assembly of the light source unit 100.

The lighting fixture 200 described in the above includes the light source unit 100 and the attaching member 101 to which the light source unit 100 is attached. Therefore, it is possible to propose the lighting fixture 200 including the light source unit 100 having the improved functionality.

(Embodiment 2)

Figure 5:
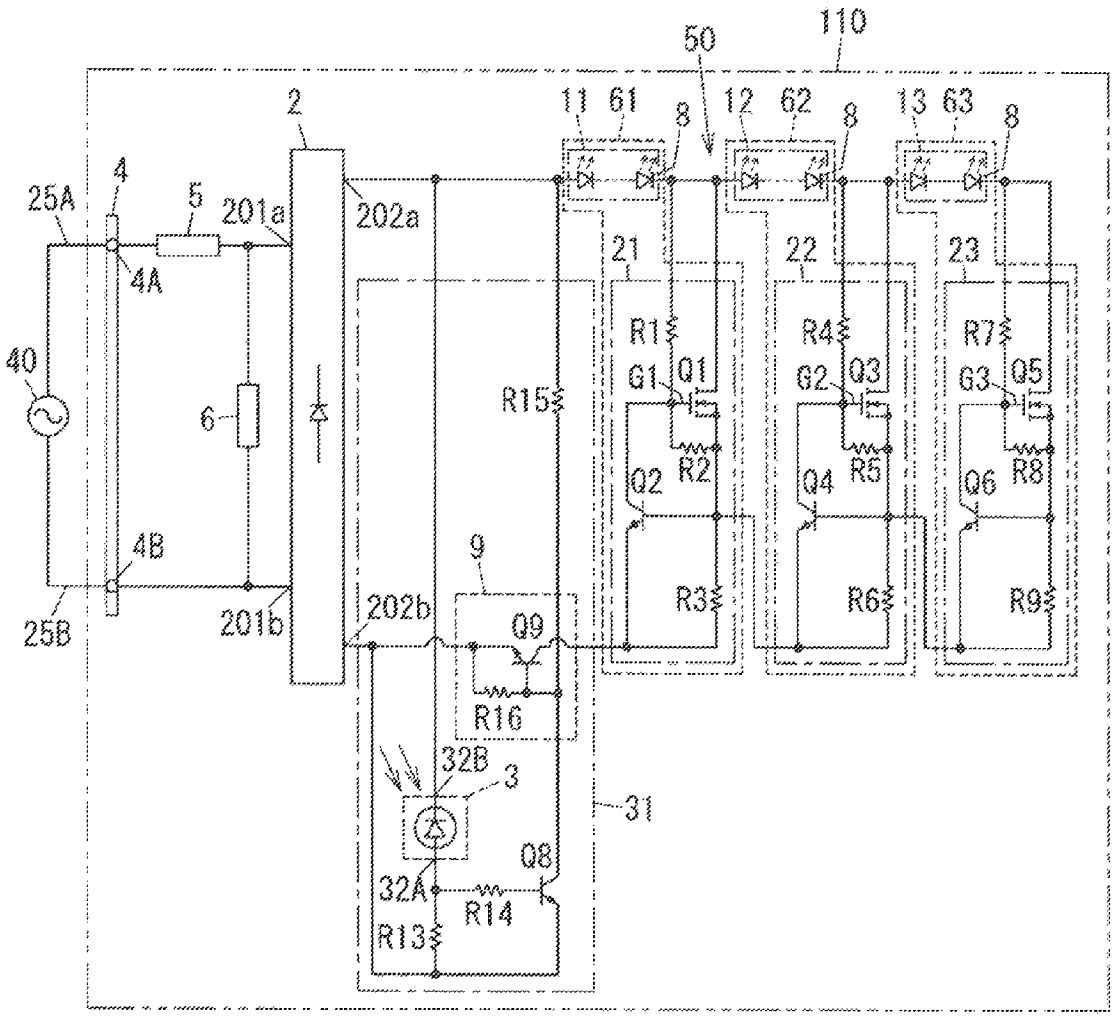
FIG. 5 is a circuit diagram illustrating a light source unit of Embodiment 2 according to the present disclosure.

A light source unit 110 of Embodiment 2 has the same basic configurations as the light source unit 100 of Embodiment 1. However, as shown in FIG. 5, the light source unit 110 is different from the light source unit 100 in including a control circuit 31 instead of the control circuit 30. Note that, the same components of the light source unit 110 as the light source unit 100 are designated by the same reference sings, and explanations thereof are omitted for avoiding redundant descriptions. The light source unit 110 may be used in the lighting fixture 200 shown in FIG. 4, as an alternative to the light source unit 100.

The control circuit 31 is configured to control the three constant current circuits 21 to 23. For example, the control circuit 31 includes the detector 3, a switching element Q8, three resistors R13 to R15, and a switching part 9.

The switching element Q8 includes a first terminal, a second terminal, and a control terminal. The switching element Q8 is, for example, an npn-type bipolar transistor. In this case, the first terminal, the second terminal, and the control terminal of the switching element Q8 correspond to a collector terminal, an emitter terminal, and a base terminal, respectively.

The switching part 9 includes, for example, a switching element Q9 and a resistor R16.

The switching element Q9 includes a first terminal, a second terminal, and a control terminal. The switching element Q9 is, for example, an npn-type bipolar transistor. In this case, the first terminal, the second terminal, and the control terminal of the switching element Q9 correspond to a collector terminal, an emitter terminal, and a base terminal, respectively.

The resistor R13 has a first end electrically connected to the anode terminal 32A of the detector 3. Further, the first end of the resistor R13 is electrically connected to a first end of the resistor R14. The resistor R13 has a second end electrically connected to the output end 202*b* for receiving a lower electric potential of the full-wave rectification circuit 2.

The resistor R14 has a second end electrically connected to the base terminal of the switching element Q8.

The resistor R15 has a first end electrically connected to the output end 202*a* for receiving a higher electric potential of the full-wave rectification circuit 2. The resistor R15 has a second end electrically connected to the collector terminal of the switching element Q8. Further, the second end of the resistor 15 is electrically connected to the base terminal of the switching element Q9.

The emitter terminal of the switching element Q8 is electrically connected to the second end of the resistor R13. The collector terminal of the switching element Q9 is electrically connected to the constant current circuit 21 (in more detail, the emitter terminal of the switching element Q2 in the constant current circuit 21). The emitter terminal of the switching element Q9 is electrically connected to the base terminal of the switching element Q9 through the resistor R16. Further, the emitter terminal of the switching element Q9 is electrically connected to the output end 202*b* for receiving a lower electric potential of the full-wave rectification circuit 2.

The control circuit 31 is configured to, when the detector 3 detects the external light, turn off the switching part 9 so as to terminate operations of the individual three constant current circuits 21 to 23.

In the light source unit 110, when the surroundings of the lighting fixture 200 become dark, the impedance component of the detector 3 (light sensor) increases, and thus no current flows into the base terminal of the switching element Q8, and therefore the switching element Q8 is kept off. Thus, current flows through the resistor R16, and this leads to increase in emitter-base voltage of the switching element Q9. As a result, in the light source unit 110, the switching element Q9 is turned on, and the constant current circuits 21, 22, and 23 are connected to the second output end 202*b* of the full-wave rectification circuit 2. Therefore, switching operations of the three switching elements Q1, Q3, and Q5 are allowed. In other words, the light source unit 110 allows the three constant current circuits 21 to 23 to operate. Thus, when the surroundings of the lighting fixture 200 become dark, the light source unit 110 can turn on the three light source groups 11 to 13 in order.

In contrast, in the light source unit 110, when the surroundings of the lighting fixture 200 become bright, an impedance component of the detector 3 (light sensor) decreases, and thus current starts to flow into the base terminal of the switching element Q8, and finally the switching element Q8 is turned on. Thus, no current flows through the resistor R16, and this leads to decrease in the emitter-base voltage of the switching element Q9. As a result, in the light source unit 110, the switching element Q9 is turned off, and an electric path between the constant current circuit 21 and the output end 202*b* for receiving a lower electric potential of the full-wave rectification circuit 2 is broken. In other words, the light source unit 110 turns off the switching part 9 and thereby terminates operations of the individual three constant current circuits 21 to 23. Thus, in the light source unit 110, when the surroundings of the lighting fixture 200 become bright, current does not flow through the three light source groups 11 to 13, and therefore it is possible to turn off the individual three light source groups 11 to 13.

In the light source unit 110, the impedance component of the light sensor used as the detector 3 changes depending on an amount of light of the surroundings of the lighting fixture 200, and therefore it is possible to change the base-emitter voltage of the switching element Q8. Additionally, in the light source unit 110, the base-emitter voltage of the switching element Q8 changes depending on an amount of light of the surroundings of the lighting fixture 200, and therefore it is possible to change the base-emitter voltage of the switching element Q9. In other words, the control circuit 31 is configured to allow the switching element Q8 and the switching element Q9 to act as resistance components. Therefore, in the light source unit 110, the switching element Q8 and the switching element Q9 can be used to operate within a region (active region) so that collector current changes in proportion to change in the base-emitter voltage.

For example, increase in the collector current of the switching element Q8 causes decrease in the current flowing through the resistor R16, and this leads to decrease in the base-emitter voltage of the switching element Q9. Thereby, the current flowing through the switching element Q9 (i.e., the current flowing through the light source groups 11 to 13) is decreased. Decrease in the collector current of the switching element Q8 causes increase in the current flowing through the resistor R16, and this leads to increase in the base-emitter voltage of the switching element Q9. Thereby, the current flowing through the switching element Q9 (i.e., the current flowing through the light source groups 11 to 13) is increased.

Figure 6:
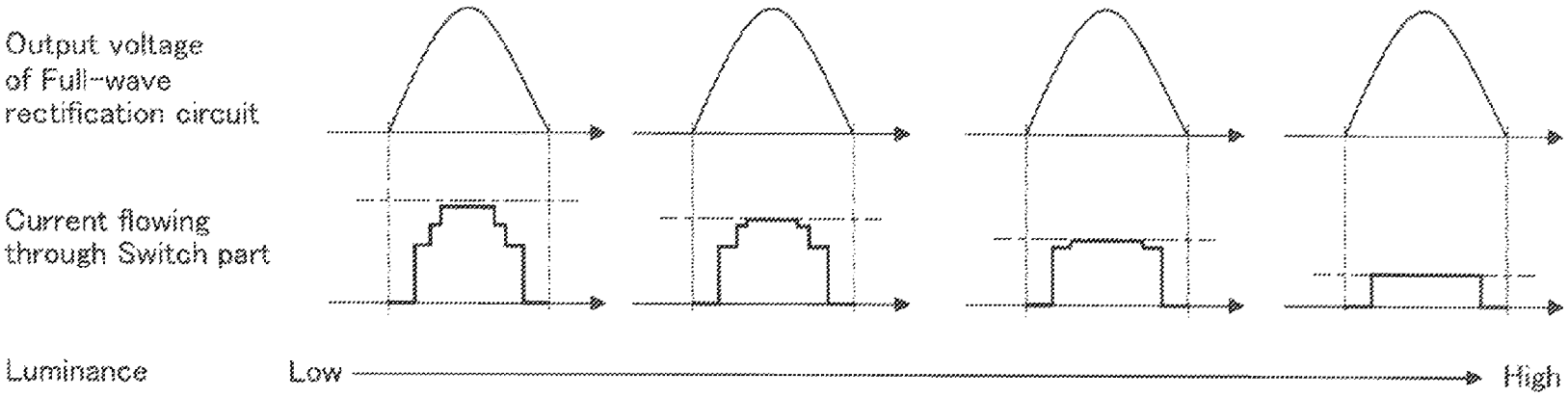
FIG. 6 relates to the light source unit of Embodiment 2 and is an explanatory diagram illustrating current which flows through a switching part.

In the light source unit 110, the switching element Q9 can be used to operate within the active region, and therefore it is possible to limit a maximum value of current flowing through the switching part 9 depending on an amount of light (degree of brightness) of the surroundings of the lighting fixture 200 (see FIG. 6). Consequently, the light source unit 110 can increase or decrease current flowing through the three light source groups 11 to 13 depending on an amount of light of the surroundings of the lighting fixture 200. Note that, FIG. 6 shows a dashed line representing a maximum value of current flowing through the switching part 9.

The switching element Q8 is not limited to an npn-type bipolar transistor, but may be an enhancement mode n-channel MOSFET or the like, for example. The switching element Q9 is not limited to an npn-type bipolar transistor, but may be an enhancement mode n-channel MOSFET or the like, for example.

As described above, in the light source unit 110, the output end 202*a* for receiving a higher electric potential of the pair of output ends 202*a* and 202*b* of the full-wave rectification circuit 2 is electrically connected to the first light source group (light source group 11). The output end 202*b* for receiving a lower electric potential of the pair of output ends 202*a* and 202*b* of the full-wave rectification circuit 2 is electrically connected to the first constant current circuit (constant current circuit 21). The control circuit 31 includes a switching part 9. The switching part 9 is provided in an electric path between the output end 202*b* for receiving a lower electric potential of the pair of output ends 202*a* and 202*b* of the full-wave rectification circuit 2 and the first constant current circuit. The control circuit 31 is configured to, when the detector 3 detects the light or signal, turn off the switching part 9 so as to terminal operations of the at least three constant current circuits 21 to 23. Accordingly, for example, in a case where the detector 3 is a light sensor, the light source unit 110 can turn off the at least three light source groups 11 to 13 when the surroundings of the lighting fixture 200 become bright. Consequently, it is also possible to improve the functionality of the light source unit 110.

Further, in the light source unit 110, the control circuit 31 includes the switching element Q8 and the switching element Q9, and is configured to allow the switching element Q8 and the switching element Q9 to act as resistance components. Therefore, in the light source unit 110, the switching element Q8 and the switching element Q9 can be individually used to operate within an active region. Hence, the light source unit 110 can limit a maximum value of current flowing through the switching part 9 depending on an amount of light of the surroundings of the lighting fixture 200. In conclusion, the light source unit 110 can increase or decrease the current flowing through the three light source groups 11 to 13 depending on an amount of light of the surroundings of the lighting fixture 200. Hence, it is also possible to more improve the functionality of the light source unit 110.

(Modifications)

Figure 7:
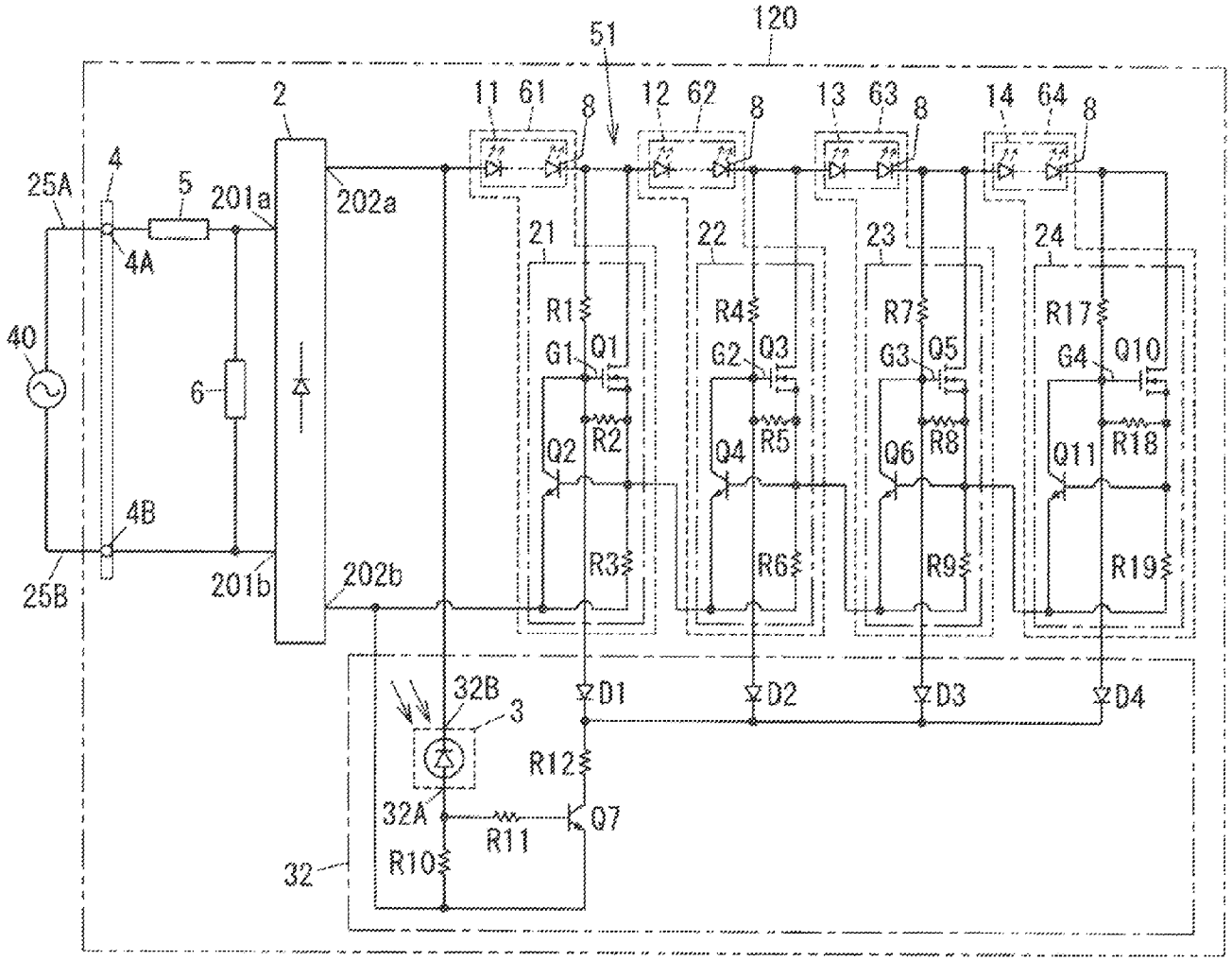
FIG. 7 is a circuit diagram illustrating a light source unit of a modification of Embodiment 1.

FIG. 7 shows a light source unit 120 according to a modification of Embodiment 1. The light source unit 120 is different from the light source unit 100 in a control circuit 32 and a light source circuit 51.

The light source circuit 51 includes four light source groups 11 to 14 and four constant current circuits 21 to 24. In other words, the light source circuit 51 includes four light source parts 61 to 64.

The fourth light source part 64 of the four light source parts 61 to 64 is a series circuit of a light source group (fourth light source group) 14 and a constant current circuit (fourth constant current circuit) 24. For example, the light source group 14 includes one or more solid light emitting elements 8. The constant current circuit 24 is configured to keep current flowing through the light source group 14 constant. As shown in FIG. 7, the constant current circuit 24 includes two switching elements (first and second switching elements) Q10 and Q11, and three resistors (first to third resistors) R17 to R19. The constant current circuit 24 is the same in circuit configurations as the constant current circuit 21, and hence detailed descriptions as for the constant current circuit 24 are omitted.

The fourth light source part 64 is electrically connected to the constant current circuit 23 of the third light source part 63. In more detail, the fourth light source part 64 is connected in parallel with the switching element Q5 of the constant current circuit 23 of the third light source part 63. Thus, the light source group 13 and the light source group 14 are connected in series with each other.

Like the control circuit 30, the control circuit 32 includes the detector 3, the switching element Q7, the three resistors R10 to R12, and the three diodes D1 to D3. Further, the control circuit 32 includes a diode D4. The diode D4 has an anode electrically connected to the constant current circuit 24 (in more detail, a control terminal G4 of the switching element Q10).

The states of the light source unit 120 include: an off-state in which all the four light source groups 11 to 14 are off; a first lighting state in which only the light source group 11 of the four light source groups 11 to 14 is on; a second lighting state in which only the light source groups 11 and 12 of the four light source groups 11 to 14 are on; a third lighting state in which only the light source groups 11 to 13 of the four light source groups 11 to 14 are on; and a fourth lighting state in which all the four light source groups 11 to 14 are on. The state of the light source unit 120 is changed to the off-state, the first lighting state, the second lighting state, the third lighting state, the fourth lighting state, the third lighting state, the second lighting state, the first lighting state, and the off-state in this order during one period of the pulsating voltage.

Figure 8:
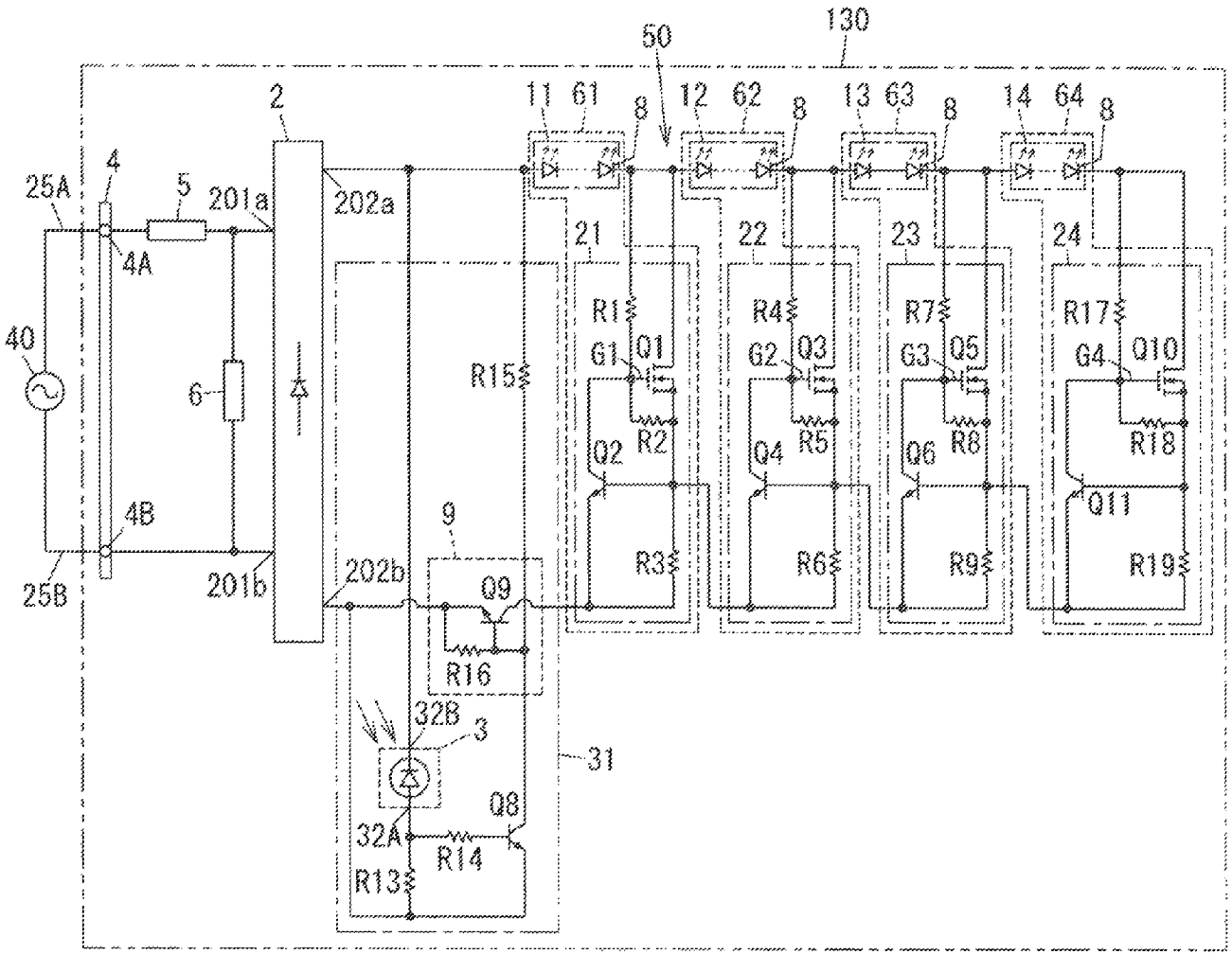
FIG. 8 is a circuit diagram illustrating a light source unit of a modification of Embodiment 2.

FIG. 8 shows a light source unit 130 according to a modification of Embodiment 2. The light source unit 130 is different from the light source unit 110 in the light source circuit 51. Like the light source unit 120, the state of the light source unit 130 is changed to the off-state, the first lighting state, the second lighting state, the third lighting state, the fourth lighting state, the third lighting state, the second lighting state, the first lighting state, and the off-state in this order during one period of the pulsating voltage.

In embodiments of the present disclosure, the light source unit may include four or more light source groups. In this case, the light source unit includes four or more constant current circuits. Further, the control circuit is configured to control the four or more constant current circuits. In summary, the light source unit may include at least three light source groups, a full-wave rectification circuit, at least three constant current circuits, and a control circuit.

In other words, the light source circuit may include N (N is an integer equal to or greater than 3) light source parts. Each light source part is a pair of a light source group including one or more solid light emitting elements and a constant current circuit connected in series with the light source group to keep, constant, current flowing through the light source group. In this case, the first light source part (pair) of the N light source parts (pairs) may be connected between the first output end and the second output end of the full-wave rectification circuit. The k-th (k is an integer equal to or greater than 2 but is equal to or smaller than N) light source part (pair) of the N light source parts (pairs) may be connected to the constant current circuit of the (k−1)-th light source part (pair) of the N light source parts (pairs). In more detail, a k-th (i.e., subsequent) pair of the N pairs is connected in parallel with the constant current circuit of a (k−1)-th (i.e., preceding) pair of the N pairs so that the light source group of the k-th pair and the light source group of the (k−1)-th pair are in series. In other words, the N light source parts are connected in sequence so that each subsequent light source part is connected in series with the light source group, and in parallel to the constant current circuit, of the preceding light source part.

(Aspects According to the Present Disclosure)

As apparent from the above embodiments, a light source unit (100, 110, 120, 130) according to the first aspect of the present disclosure includes: a light source circuit (50, 51) including N pairs (61, 62, 63, 64) of a light source group (11, 12, 13, 14) including one or more solid light emitting elements (8) and a constant current circuit (21, 22, 23, 24) connected in series with the light source group (11, 12, 13, 14) to keep, constant, current flowing through the light source group (11, 12, 13, 14), where N is an integer equal to or greater than 3; a full-wave rectification circuit (2) which includes a first output end (202*a*) and a second output end (202*b*) and is configured to perform full-wave rectification on AC voltage to cause DC voltage between the first output end (202*a*) and the second output end (202*b*); and a control circuit (30, 31, 32) including a detector (3) configured to detect light or signal from an external source. A first pair (61) of the N pairs (61, 62, 63, 64) is connected between the first output end (202*a*) and the second output end (202*b*) of the full-wave rectification circuit (2). A k-th (i.e., subsequent) pair (62, 63, 64) of the N pairs (61, 62, 63, 64) is connected in parallel with the constant current circuit (21, 22, 23) of a (k−1)-th (i.e., preceding) pair (61, 62, 63) of the N pairs (61, 62, 63, 64) so that the light source group (12, 13, 14) of the k-th pair and the light source group (11, 12, 13) of the (k−1)-th pair are in series, where k is an integer equal to or greater than 2 and equal to or smaller than N. The control circuit (30, 31, 32) is configured to, when the detector (3) detects the light or signal, terminate operations of constant current circuits (21, 22, 23, 24) of the N pairs (61, 62, 63, 64) or limit current flowing through light source groups (11, 12, 13, 14) of the N pairs (61, 62, 63, 64).

In the light source unit (100, 110, 120, 130) according the second aspect of the present disclosure, realized in combination with the first aspect, in each of the N pairs (61, 62, 63, 64), the constant current circuit (21, 22, 23, 24) includes a switching element (Q1, Q3, Q5, Q10) connected to the light source group (11, 12, 13, 14) and is configured to keep current flowing through the switching element (Q1, Q3, Q5, Q10) constant. The k-th pair (62, 63, 64) is connected to the switching element (Q1, Q3, Q5) of the constant current circuit (21, 22, 23) of the (k−1)-th pair (61, 62, 63).

In the light source unit (100, 110, 120, 130) according the third aspect of the present disclosure, realized in combination with the second aspect, the control circuit (30, 32) is configured to, when the detector (3) detects the light or signal, turn off the switching elements (Q1, Q3, Q5, Q10) of the constant current circuits (21, 22, 23, 24) of the N pairs (61, 62, 63, 64).

In the light source unit (100, 120) according the fourth aspect of the present disclosure, realized in combination with the second aspect, each of the switching elements (Q1, Q3, Q5, Q10) includes a control terminal (G1, G2, G3, G4) and is configured to change current flowing through the switching element (Q1, Q3, Q5, Q10) according to an electric potential at the control terminal (G1, G2, G3, G4). The control circuit (30, 32) is configured to adjust electric potentials at the control terminals (G1, G2, G3, G4) of switching elements (Q1, Q3, Q5, Q10) of the constant current circuits (21, 22, 23, 24) of the N pairs (61, 62, 63, 64) so that current flowing through the light source groups (11, 12, 13, 14) of the N pairs (61, 62, 63, 64) decreases with an increase in an intensity of the light detected by the detector (3).

In the light source unit (100, 120) according the fifth aspect of the present disclosure, realized in combination with the second aspect, the full-wave rectification circuit (2) is configured to cause the DC voltage between the first output end (202*a*) and the second output end (202*b*) so that an electric potential at the first output end (202*a*) is higher than an electric potential at the second output end (202*b*). Each of the switching element (Q1, Q3, Q5, Q10) includes a control terminal (G1, G2, G3, G4) and is configured to change current flowing through the switching element (Q1, Q3, Q5, Q10) according to an electric potential at the control terminal (G1, G2, G3, G4). The control circuit (30, 32)

includes a switching part (switching element Q7) electrically connected between the control terminals (G1, G2, G3, G4) of the switching elements (Q1, Q3, Q5, Q10) of the constant current circuits (21, 22, 23, 24) of the N pairs (61, 62, 63, 64) and the second output end (202*b*). The control circuit (30, 32) is configured to, when the detector (3) detects the light or signal, control the switching part (Q7) to terminate the operations of the constant current circuits (21, 22, 23, 24) of the N pairs (61, 62, 63, 64) or limit the current flowing through the light source groups (11, 12, 13, 14) of the N pairs (61, 62, 63, 64).

In the light source unit (110, 130) according the sixth aspect of the present disclosure, realized in combination with the first aspect, the full-wave rectification circuit (2) is configured to cause the DC voltage between the first output end (202*a*) and the second output end (202*b*) so that an electric potential at the first output end (202*a*) is higher than an electric potential at the second output end (202*b*). The control circuit (31) includes a switching part (9) electrically connected between a constant current circuit (21) of the first pair (61) and the second output end (202*b*). The control circuit (31) is configured to, when the detector (3) detects the light or signal, turn off the switching part (9).

In the light source unit (110, 130) according the seventh aspect of the present disclosure, realized in combination with the first aspect, the full-wave rectification circuit (2) is configured to cause the DC voltage between the first output end (202*a*) and the second output end (202*b*) so that an electric potential at the first output end (202*a*) is higher than an electric potential at the second output end (202*b*). The control circuit (31) includes a switching part (9) electrically connected between a constant current circuit (21) of the first pair (61) and the second output end (202*b*). The control circuit (31) is configured to, when the detector (3) detects the light or signal, control the switching part (9) to limit current flowing through the light source groups (11, 12, 13, 14) of the N pairs (61, 62, 63, 64).

The light source unit (100, 110, 120, 130) according the eighth aspect of the present disclosure, realized in combination with the first aspect, further includes a substrate (7) having a front surface (7*a*) and a rear surface (7*b*). The light source groups (11, 12, 13, 14) of the N pairs (61, 62, 63, 64) are on the front surface (7*a*) of the substrate (7). The detector (3) is on the rear surface (7*b*) of the substrate (7).

The lighting fixture (200) according to the ninth aspect of the present disclosure includes: the light source unit (100, 110, 120, 130) of any one of the first to eighth aspects; and an attaching member (101) for holding the light source unit (100, 110, 120, 130).

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A light source unit, comprising:

a light source circuit including N pairs of a light source group including one or more solid light emitting elements and a constant current circuit connected in series with the light source group to keep, constant, current flowing through the light source group, where N is an integer equal to or greater than 3;

a full-wave rectification circuit which includes a first output end and a second output end and is configured to perform full-wave rectification on AC voltage to cause DC voltage between the first output end and the second output end; and a control circuit including a detector configured to detect light or signal from an external source, a first pair of the N pairs being connected between the first output end and the second output end of the full-wave rectification circuit, a k-th pair of the N pairs being connected in parallel with the constant current circuit of a (k−1)-th pair of the N pairs so that the light source group of the k-th pair and the light source group of the (k−1)-th pair are in series, where k is an integer equal to or greater than 2 and equal to or smaller than N, the control circuit being configured to, when the detector detects the light or signal, terminate operations of constant current circuits of the N pairs or limit current flowing through light source groups of the N pairs, in each of the N pairs, the constant current circuit including a switching element connected to the light source group and is configured to keep current flowing through the switching element constant, the k-th pair is connected to the switching element of the constant current circuit of the (k−1)-th pair, the full-wave rectification circuit being configured to cause the DC voltage between the first output end and the second output end so that an electric potential at the first output end is higher than an electric potential at the second output end, each of the switching elements including a control terminal and is configured to change current flowing through the switching element according to an electric potential at the control terminal, the control circuit including a switching part electrically connected between each of the control terminals of the switching elements of the constant current circuits of the N pairs and the second output end, the control circuit being configured to, when the detector detects the light or signal, control the switching part to terminate the operations of the constant current circuits of the N pairs or limit the current flowing through the light source groups of the N pairs, in each of the N pairs, the control terminal of the switching element being electrically connected to the first output terminal of the full-wave rectification circuit through a resistor and the light source group, and the switching part being electrically connected to each of the control terminals of the switching elements of the constant current circuits of the N pairs, but not through any of the light source groups of the N pairs.

2. The light source unit according to claim 1, wherein:

the control circuit is configured to, when the detector detects the light or signal, turn off the switching elements of the constant current circuits of the N pairs.

3. The light source unit according to claim 1, wherein:

each of the switching elements includes a control terminal and is configured to change current flowing through the switching element according to an electric potential at the control terminal; and the control circuit is configured to adjust electric potentials at the control terminals of switching elements of the constant current circuits of the N pairs so that current flowing through the light source groups of the N pairs decreases with an increase in an intensity of the light detected by the detector.

4. The light source unit according to claim 1, further comprising a substrate having a front surface and a rear surface, the light source groups of the N pairs being on the front surface of the substrate, and the detector being on the rear surface of the substrate.

5. A lighting fixture, comprising:

the light source unit of claim 1; and an attaching member for holding the light source unit.

* * * * *